US009669986B1

(12) United States Patent
Evans

(10) Patent No.: US 9,669,986 B1
(45) Date of Patent: Jun. 6, 2017

(54) MULTIPURPOSE INSULATED COOLER/HEATER BAG AND ASSOCIATED METHOD

(71) Applicant: Angela Evans, Jersey City, NJ (US)

(72) Inventor: Angela Evans, Jersey City, NJ (US)

( * ) Notice: Subject to any disclaimer, the term of this patent is extended or adjusted under 35 U.S.C. 154(b) by 0 days.

(21) Appl. No.: 14/273,502

(22) Filed: May 8, 2014

Related U.S. Application Data

(63) Continuation-in-part of application No. 13/210,336, filed on Aug. 15, 2011, now abandoned.

(60) Provisional application No. 61/373,363, filed on Aug. 13, 2010.

(51) Int. Cl.
*H05B 3/00* (2006.01)
*B65D 81/18* (2006.01)
*B65D 81/38* (2006.01)

(52) U.S. Cl.
CPC ..... *B65D 81/18* (2013.01); *B65D 81/38* (2013.01)

(58) Field of Classification Search
CPC A45C 15/00; A45C 3/04; A45C 11/20; A45C 13/02; A47J 36/2483; F25D 2231/801; B65D 81/18; B65D 81/38; B65D 81/2069; B65D 81/007; B65D 81/3809; B65D 81/3806; B65D 81/382
See application file for complete search history.

(56) References Cited

U.S. PATENT DOCUMENTS 5,569,401 A * 10/1996 Gilliland ..... A47K 10/06 219/386
2003/0024960 A1* 2/2003 Greenstein ..... A45C 11/20 224/153
2006/0283205 A1* 12/2006 Carriere ..... A45C 13/02 62/457.2

* cited by examiner

*Primary Examiner* — Shawntina Fuqua

(57) ABSTRACT

A cooler and heater bag includes a dry storage compartment, a cold storage compartment inside the dry storage compartment, a bottle warming compartment inside the dry storage compartment, a flexible shoulder strap having a first end anchored to the dry storage compartment, and a fastener attached to the dry storage compartment as well as anchored to a second end of the shoulder strap respectively. The fastener and the second end of the shoulder strap contemporaneously move along a bidirectional linear path defined along a top surface of the dry storage compartment. The dry storage compartment is in fluid communication with one of the cold storage compartment and the bottle warming compartment. The first side wall is oppositely spaced from the second side wall wherein each of the first side wall and the second side wall are located inside the dry storage compartment.

11 Claims, 6 Drawing Sheets

MULTIPURPOSE INSULATED COOLER/HEATER BAG AND ASSOCIATED METHOD

CROSS REFERENCE TO RELATED APPLICATIONS

This is a continuation-in-part application of U.S. patent application Ser. No. 13/210,336 filed on Aug. 15, 2011, currently pending, which claims the benefit of U.S. Provisional Application No. 61/373,363, filed Aug. 13, 2010, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE DISCLOSURE

Technical Field

This disclosure relates to infant care products and, more particularly, to a multipurpose insulated cooler/heater bag for providing users with a practical means of storing items needed on the go, as well as enabling them to easily keep warm baby bottles and other perishables chilled while travelling.

Prior Art

For most parents of babies or toddlers, a baby bottle is "must have" item, never to be without. Baby bottles not only provide nourishing milk to an infant, but also help to soothe and comfort a baby, especially in times of colic and fussiness. Not limited to bottle fed babies, a baby bottle is also used by most nourishing mothers a means of feeding their child when traveling or when in public. From the time of birth, when a bottle provides the sole means of nourishment, until the toddler years, when a bottle is offered as a nutritional accompaniment to solid foods or as a nighttime snack, a bottle of warm milk is essential for a healthy, happy child.

When giving an infant a baby bottle, perhaps the most important thing to keep in mind is the temperature of the milk contained within. Giving an infant a baby bottle that contains cold milk can upset the baby's tummy. On the other hand, milk that is too warm can scald the baby, leaving painful and dangerous burns to the mouth, throat and stomach. Parents warm their infant's bottles through a variety of methods. Placing a bottle in a bath of boiling water, warming it in the microwave or placing it under a running faucet are all popular ways that people warm a baby bottle. While all of these methods can be easily achieved in the home, providing a child a warm and satisfying bottle when away from home can be extremely difficult.

In particular, many consumers are faced with the dilemma of satisfying their child's hunger, when traveling. While most diaper bags are designed with integrated storage compartments created expressly for baby bottles, these units offer no means of keeping a bottle chilled prior to warming, as well as warming the bottle upon demand. While a tepid bottle can be unpleasant for the child, giving an infant a cold bottle often results in the child suffering painful stomach aches.

Unfortunately, a child is often hungry at inopportune moments, such as when Mom and Dad are driving down long stretches of highway and a rest stop is nowhere in sight. As many caregivers may attest, failing to provide a hungry infant a bottle on demand, often results in a cranky and irritable child. Extremely frustrating, searching in vain for a truck stop or restaurant, simply in order to warm a baby bottle to an appropriate drinking temperature, all while a child cries angrily to be fed, can be a very unnerving experience.

Accordingly, a need remains for an apparatus in order to overcome the above-noted shortcomings. The present disclosure satisfies such a need by providing a multipurpose insulated cooler/heater bag that is convenient and easy to use, lightweight yet durable in design, versatile in its applications, and designed for providing a user with a practical means of storing the many items needed on the go, as well as enable them to easily keep bottles and other perishables chilled during transport, while also enabling them to warm the child's bottle prior to feedings.

BRIEF SUMMARY OF THE DISCLOSURE

In view of the foregoing background, it is therefore an object of the present disclosure to provide a multipurpose insulated cooler and heater bag for providing users with a practical means of storing items needed on the go, as well as enabling them to easily keep warm baby bottles and other perishables chilled and/or warmed while travelling. These and other objects, features, and advantages of the disclosure are provided by a multipurpose insulated cooler and heater bag including a dry storage compartment having an outer perimeter wall, a cold storage compartment removably disposed inside the dry storage compartment wherein the cold storage compartment has a first side wall abutted against the outer perimeter wall, and a bottle warming compartment removably disposed inside the dry storage compartment wherein the bottle warming compartment having a second side wall abutted against the outer perimeter wall. A shoulder strap has a first end anchored to an exterior surface of the dry storage compartment, and a fastener is attached to the dry storage compartment as well as anchored to a second end of the shoulder strap respectively. Notably, the fastener and the second end of the shoulder strap contemporaneously move along a bidirectional linear path defined along a top surface of the dry storage compartment. Furthermore, the dry storage compartment is in fluid communication with one of the cold storage compartment and the bottle warming compartment. Advantageously, the first side wall is oppositely spaced from the second side wall wherein each of the first side wall and the second side wall are located inside the dry storage compartment.

In a non-limiting exemplary embodiment, the bag further includes a plurality of first passageways passing through the outer perimeter wall and the first side wall such that the dry storage compartment is in fluid communication with the cold storage compartment.

In a non-limiting exemplary embodiment, the first passageways include a plurality of first horizontally-oriented linear passageways each having a longitudinal length extending through an entire thickness of the outer perimeter wall and the first side wall, and a plurality of first criss-crossed linear passageways each having axially opposed ends in direct fluid communication with the first horizontally-oriented linear passageways, respectively.

In a non-limiting exemplary embodiment, the dry storage compartment is in fluid communication with both of the cold storage compartment and the bottle warming compartment.

In a non-limiting exemplary embodiment, the bag further includes a plurality of second passageways passing through the outer perimeter wall and the second side wall such that the dry storage compartment is in fluid communication with the bottle warming compartment.

In a non-limiting exemplary embodiment, the second passageways include a plurality of second horizontally-oriented linear passageways each having a longitudinal length extending through a combined thickness of the outer perimeter wall and the second side wall, and a plurality of second crisscrossed linear passageways each having axially opposed ends in direct fluid communication with the second horizontally-oriented linear passageways, respectively.

The present disclosure further includes a method of utilizing multipurpose insulated cooler and heater bag. Such a method includes the steps of: providing a dry storage compartment having an outer perimeter wall; providing and removably disposing a cold storage compartment inside the dry storage compartment wherein the cold storage compartment has a first side wall abutted against the outer perimeter wall; providing and removably disposing a bottle warming compartment inside the dry storage compartment wherein the bottle warming compartment has a second side wall abutted against the outer perimeter wall; oppositely spacing the first side wall from the second side wall; locating each the first side wall and the second side wall inside the dry storage compartment; fluidly communicating the dry storage compartment with one of the cold storage compartment and the bottle warming compartment; providing and anchoring a first end of a shoulder strap to an exterior surface of the dry storage compartment; providing and attaching a fastener to the dry storage compartment; anchoring the fastener to a second end of the shoulder strap; and contemporaneously moving the fastener and the second end of the shoulder strap along a bidirectional linear path defined along a top surface of the dry storage compartment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the disclosure in any way.

BRIEF DESCRIPTION OF THE SEVERAL VIEWS OF THE DRAWING

The novel features believed to be characteristic of this disclosure are set forth with particularity in the appended claims. The disclosure itself, however, both as to its organization and method of operation, together with further objects and advantages thereof, may best be understood by reference to the following description taken in connection with the accompanying drawings in which:

Figure 1:
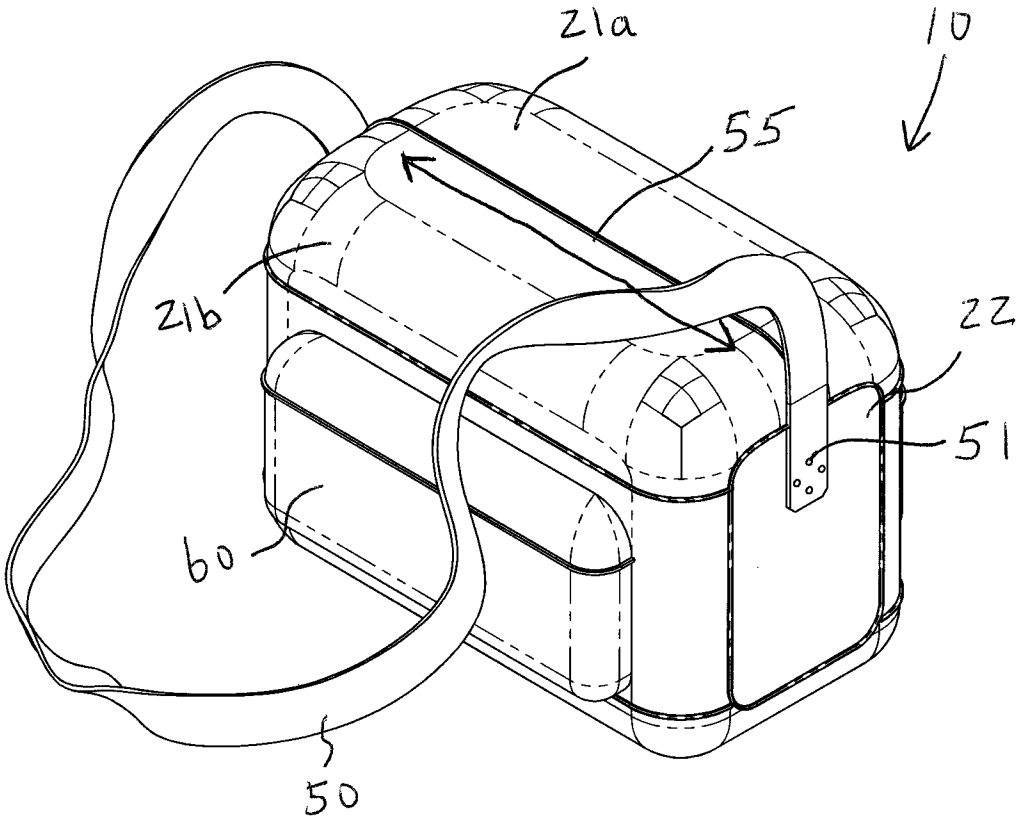
FIG. 1 is a perspective view showing a front side of a multipurpose heater and cooler bag, in accordance with the present disclosure.
Figure 2:
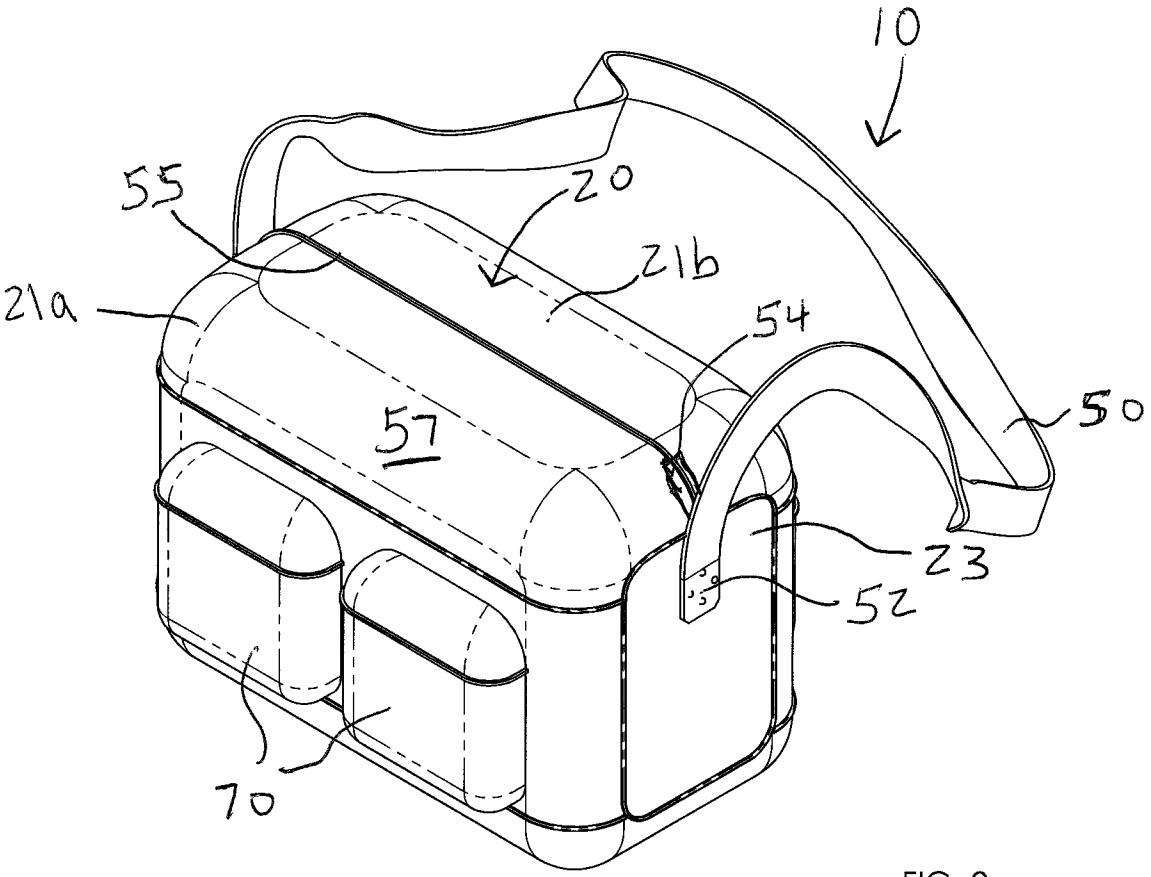
FIG. 2 is a perspective view showing a rear side of a multipurpose heater and cooler bag, in accordance with the present disclosure.
Figure 3:
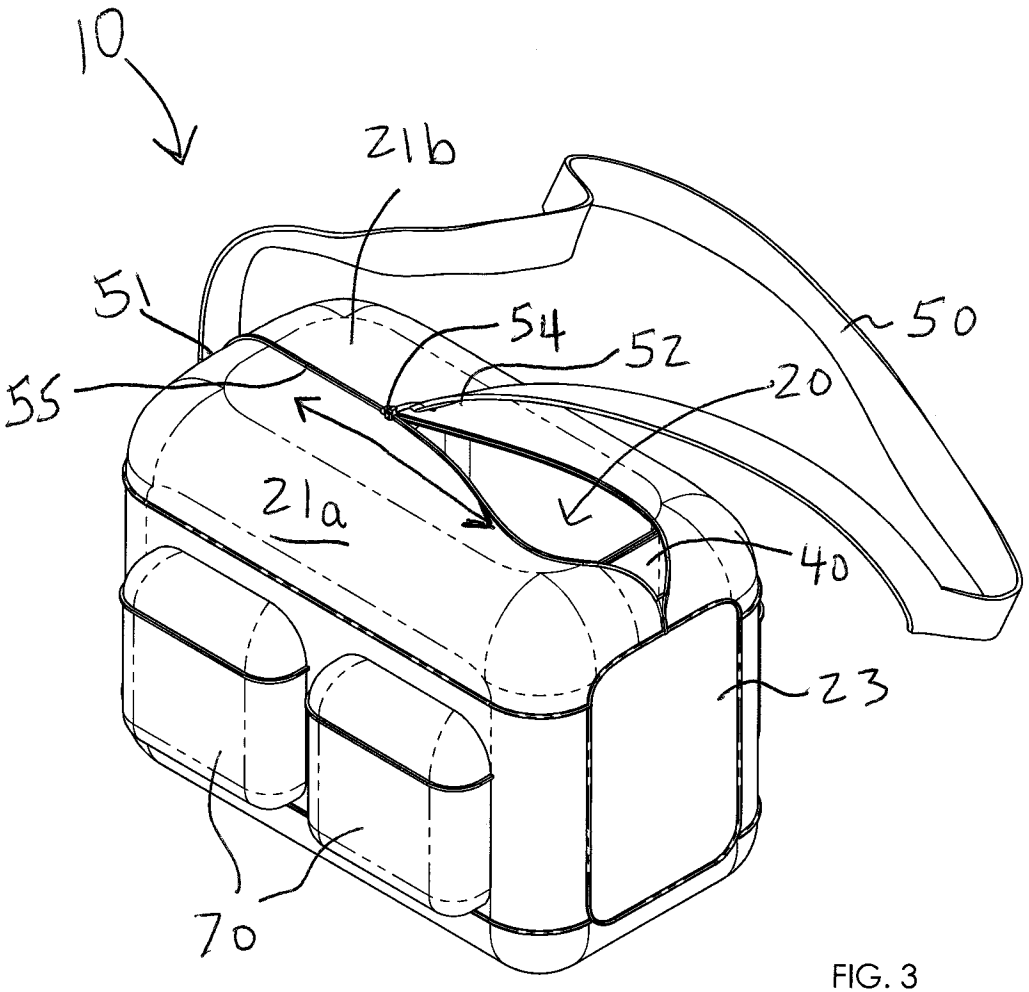
FIG. 3 is a perspective view of the multipurpose bag shown in FIG. 2 wherein the cold storage compartment and bottle warming compartment are spaced apart and located inside the dry storage compartment.

Those skilled in the art will appreciate that the figures are not intended to be drawn to any particular scale; nor are the figures intended to illustrate every embodiment of the disclosure. The disclosure is not limited to the exemplary embodiments depicted in the figures or the shapes, relative sizes or proportions shown in the figures.

DETAILED DESCRIPTION OF THE DISCLOSURE

The present disclosure will now be described more fully hereinafter with reference to the accompanying drawings, in which a preferred embodiment of the disclosure is shown. This disclosure may, however, be embodied in many different forms and should not be construed as limited to the embodiment set forth herein. Rather, this embodiment is provided so that this application will be thorough and complete, and will fully convey the true scope of the disclosure to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present disclosure" merely for convenience and without intending to voluntarily limit the scope of this application to any particular disclosure or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

The apparatus of this disclosure is referred to in FIGS. 1-7 and is intended to provide a multipurpose insulated cooler/heater bag 10. It should be understood that the present disclosure may be used to store, cooler, and warm many different types of infant necessities and the like, and should not be limited to the uses described herein.

Referring to FIGS. 1-7 in general, a multipurpose insulated cooler and heater bag 10 is disclosed for providing users a practical means of storing items needed on the go, as well as enabling them to easily keep cold/warm baby bottles and other perishables chilled/warmed foodstuff while travelling. Such a multipurpose insulated cooler and heater bag 10 preferably includes a dry storage compartment 20, a cold storage compartment 30 removably disposed entirely inside the dry storage compartment 20, a bottle warmer 40 removably disposed entirely inside the dry storage compartment 20, a flexible shoulder strap 50 having a first end 51 anchored to an exterior surface of the dry storage compartment 20, and a fastener 54 attached to the dry storage compartment 20 as well as anchored to a second end 52 of the shoulder strap 50, respectively. In this manner, the fastener 54 and the second end 52 of the shoulder strap 50 contemporaneously move along a bidirectional linear path 55 defined along a top surface 57 of the dry storage compartment 20. Such a structural configuration provides the unexpected and unpredictable advantage of preventing strap 50 from bunching up or becoming disposed within the dry storage compartment 20 when the fastener 54 is opened. By displacing the strap 50 to one end of the dry storage compartment 20, the strap 50 is effectively maintained clear of the opening to access the interior of the dry storage compartment 20.

In a non-limiting exemplary embodiment, a diaper change compartment 60 may be attached to the exterior surface of the dry storage compartment 20. Such a diaper change compartment 60 may be isolated from an interior of the dry storage compartment 20 as well as cold storage compartment 30 and bottle warmer 40, respectively.

In a non-limiting exemplary embodiment, a plurality of auxiliary compartments 70 may be attached to the exterior surface of the dry storage compartment 20 and thereby situated subjacent to the fastener 54 as well as the first and second ends 51, 52 of strap 50, respectively.

Figure 4:
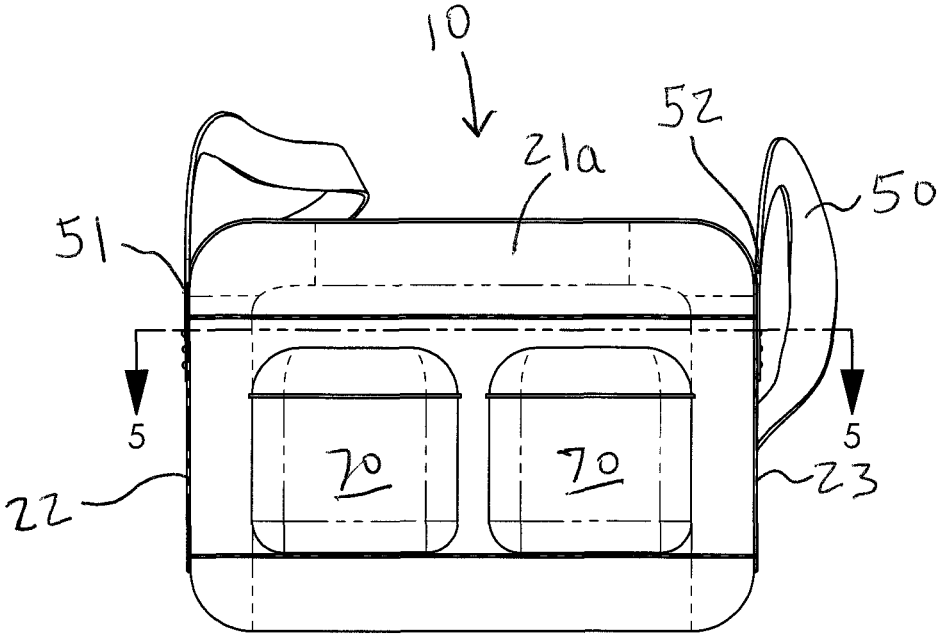
FIG. 4 is a side elevational view of the multipurpose bag shown in FIG. 3.
Figure 5:
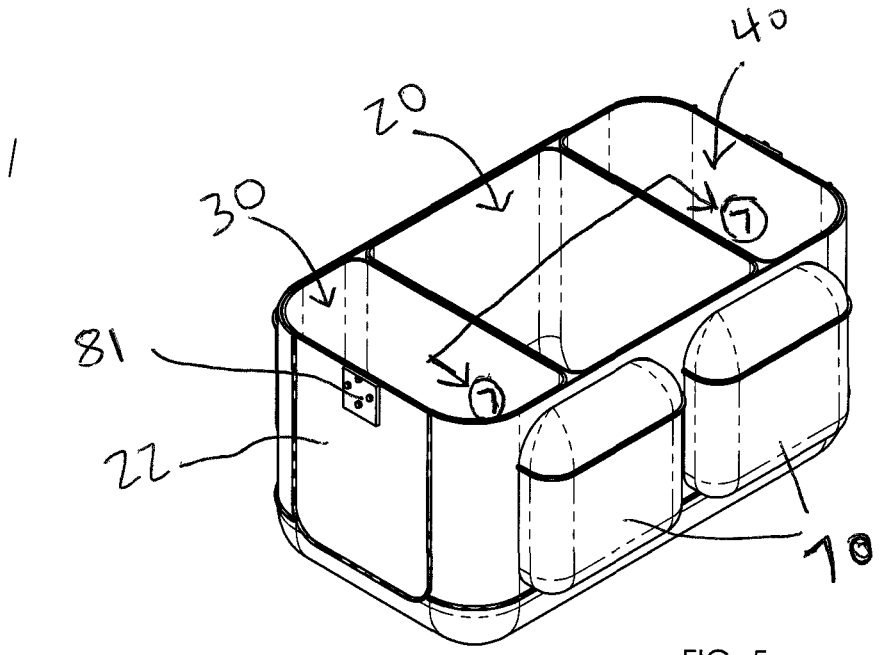
FIG. 5 is a cross-sectional view taken along line 5-5 illustrated in FIG. 4.
Figure 6:
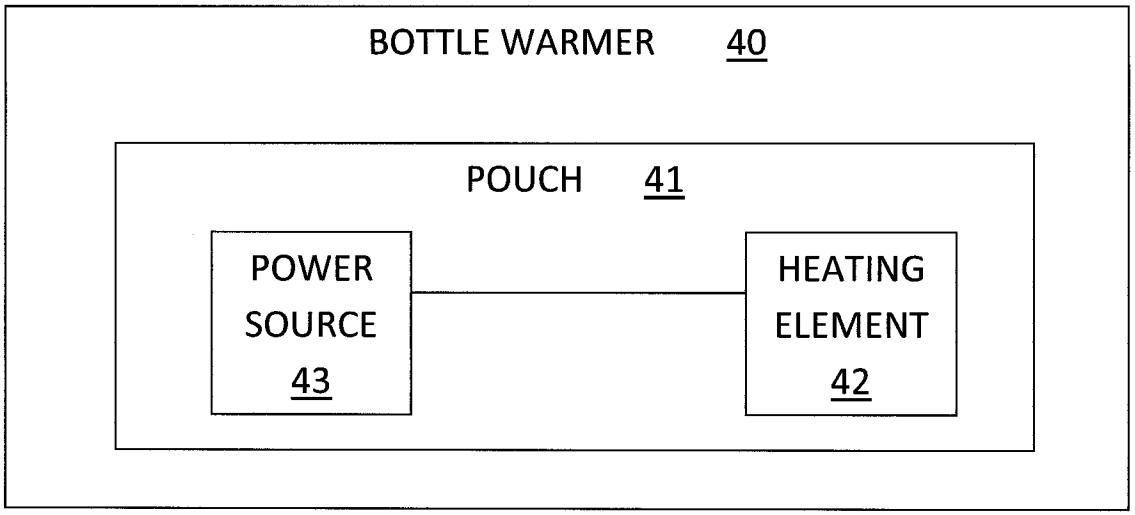
FIG. 6 is a schematic block diagram illustrating the interrelationship between the major electronic components of the bottle warmer.
Figure 7:
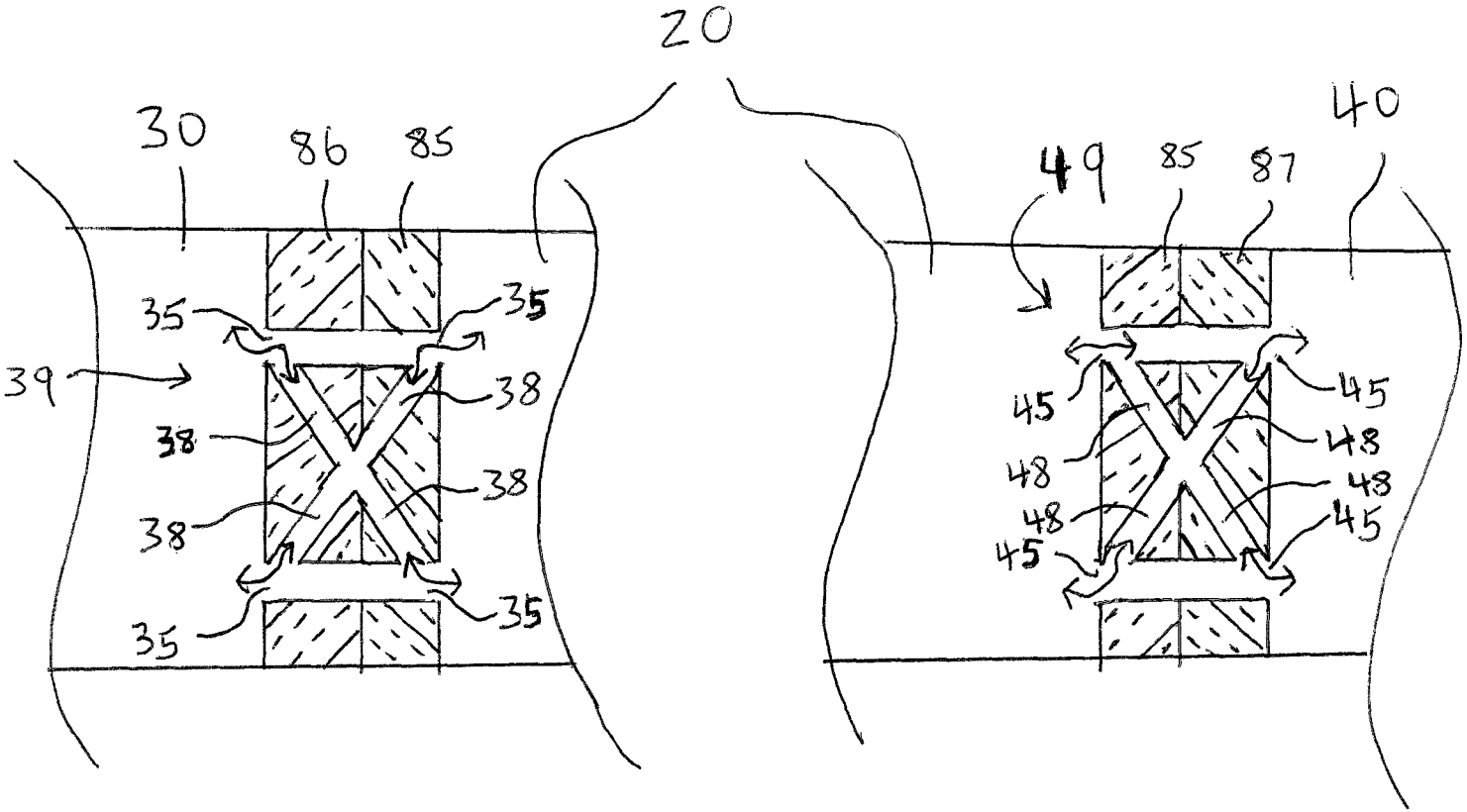
FIG. 7 is an enlarged cross-sectional view taken along line 7-7 illustrated in FIG. 5.

In a non-limiting exemplary embodiment, as perhaps best shown in FIG. 4, the bottle warmer 40 preferably includes a pouch 41 isolated from the dry storage compartment 20 and the cold storage compartment 30, a heating element 42 located within the pouch 41, and a power source 43 communicatively coupled to the heating element 42. Such a structural configuration provides the unexpected and unpredictable advantage of permitting a user to selectively heat bottles, diapers, wipes, etc. without affecting the contents in the cold storage compartment 30. Such a structural configuration provides the unexpected and unpredictable advantage of separating solid/liquid foodstuff as well as cold/hot foodstuff. The bottle warmer 40 may run on conventional electricity, power supplied by a universal car adapter to be easily plugged into any vehicle lighter, or an internally contained battery or any other portable suitable power well known in the art.

In a non-limiting exemplary embodiment, fastener 54 may be a zipper extending along a top surface 57 of the dry storage compartment 20. Such a dry storage compartment 20 may be bifurcated into first and second halves 21*a*, 21*b* as fastener 54 is linearly displaced towards the first end 51 of the strap 50 and thereby opened. In this manner, a user may easily access both cold storage compartment 30 and bottle warmer 40 while the strap is gathered at one end of the bag 10.

In a non-limiting exemplary embodiment, the first end 51 of the strap 50 preferably remains statically fixed to a proximal end 22 of the dry storage compartment 20 while the second end 52 of the strap 50 is dynamically displaced along the bidirectional linear path 55. Such a structural configuration provides the unexpected and unpredictable advantage of ensuring the strap 50 is carried over to an exterior end of the dry storage compartment 20 and thereby remains out of the way when accessing the interior of the dry storage compartment 20.

In a non-limiting exemplary embodiment, the diaper change protector compartment 60 may preferably store a removable changing pad (not shown) thereby providing a soft and sanitary surface on which to change the child's diaper. The dry storage compartment 20 may preferably be double stitched and reinforced and may be manufactured from nylon, canvas, quilted cotton, leather or other material well known in the art.

In a non-limiting exemplary embodiment, the interior of the insulated cold compartment 30 may be kept cold via removable ice packs (not shown).

In a non-limiting exemplary embodiment, the present disclosure may further include a method of utilizing a multipurpose insulated cooler and heater bag 10. Such a method preferably includes the chronological steps of: providing a dry storage compartment 20; providing a cold storage compartment 30; removably disposing the cold storage compartment 30 entirely inside the dry storage compartment 20; providing a bottle warmer 40; and removably disposing the bottle warmer 40 entirely inside the dry storage compartment 20.

The method further includes the chronological steps of: providing a flexible shoulder strap 50; anchoring a first end 51 of the shoulder strap 50 to an exterior surface of the dry storage compartment 20; providing and attaching a fastener 54 to the dry storage compartment 20; anchoring the fastener 54 to a second end 52 of the shoulder strap 50 respectively; contemporaneously moving the fastener 54 and the second end 52 of the shoulder strap 50 along a bidirectional linear path 55 defined along a top surface 57 of the dry storage compartment 20; providing and positioning a bottle (not shown) into the cold storage compartment 30; removing the bottle from the cold storage compartment 30 and placing the bottle into the bottle warmer 40 until contents within the bottle are warmed to a desired temperature; and feeding the warmed contents of the bottle to an infant.

Referring to FIGS. 1-7 in general, a multipurpose insulated cooler and heater bag 10 including a dry storage compartment 20 having an outer perimeter wall 85, a cold storage compartment 30 removably disposed inside the dry storage compartment 20 wherein the cold storage compartment 30 has a first side wall 86 abutted against the outer perimeter wall 85, and a bottle warming compartment 40 removably disposed inside the dry storage compartment 20 wherein the bottle warming compartment 40 having a second side wall 87 abutted against the outer perimeter wall 85. A shoulder strap 50 has a first end 51 anchored to an exterior surface of the dry storage compartment 20, and a fastener 54 is attached to the dry storage compartment 20 as well as removably anchored to a second end 52 of the shoulder strap 50 respectively (e.g., via snap button, hook and loop fastener, clip, etc.) Notably, the fastener 54 and the second end 52 of the shoulder strap 50 contemporaneously move along a bidirectional linear path defined along a top surface of the dry storage compartment 20. Furthermore, the dry storage compartment 20 is in fluid communication with one of the cold storage compartment 30 and the bottle warming compartment 40. Advantageously, the first side wall 86 is oppositely spaced from the second side wall 87 wherein each of the first side wall 86 and the second side wall 87 are located inside the dry storage compartment 20.

In a non-limiting exemplary embodiment, the bag 10 further includes a plurality of first passageways 39 passing through the outer perimeter wall 85 and the first side wall 86 such that the dry storage compartment 20 is in fluid communication with the cold storage compartment 30.

In a non-limiting exemplary embodiment, the first passageways 39 include a plurality of first horizontally-oriented linear passageways 35 each having a longitudinal length extending through an entire combined thickness of the outer perimeter wall 85 and the first side wall 86, and a plurality of first crisscrossed linear passageways 38 each having axially opposed ends in direct fluid communication with the first horizontally-oriented linear passageways 35, respectively.

In a non-limiting exemplary embodiment, the dry storage compartment 20 is in fluid communication with both of the cold storage compartment 30 and the bottle warming compartment 40.

In a non-limiting exemplary embodiment, the bag 10 further includes a plurality of second passageways 49 passing through the outer perimeter wall 85 and the second side wall 87 such that the dry storage compartment 20 is in fluid communication with the bottle warming compartment 40.

In a non-limiting exemplary embodiment, the second passageways 49 include a plurality of second horizontally-oriented linear passageways 45 each having a longitudinal length extending through an entire combined thickness of the outer perimeter wall 85 and the second side wall 87, and a plurality of second crisscrossed linear passageways 48 each having axially opposed ends in direct fluid communication with the second horizontally-oriented linear passageways 45, respectively.

The present disclosure further includes a method of utilizing multipurpose insulated cooler and heater bag 10. Such a method includes the steps of: providing a dry storage compartment 20 having an outer perimeter wall 85; providing and removably disposing a cold storage compartment 30 inside the dry storage compartment 20 wherein the cold storage compartment 30 has a first side wall 86 abutted against the outer perimeter wall 85; providing and removably disposing a bottle warming compartment 40 inside the dry storage compartment 20 wherein the bottle warming compartment 40 has a second side wall 87 abutted against the outer perimeter wall 85; oppositely spacing the first side wall 86 from the second side wall 87; locating each the first side wall 86 and the second side wall 87 inside the dry storage compartment 20; fluidly communicating the dry storage compartment 20 with one of the cold storage compartment 30 and the bottle warming compartment 40; providing and anchoring a first end 51 of a shoulder strap 50 to an exterior surface of the dry storage compartment 20; providing and attaching a fastener to the dry storage compartment 20; anchoring the fastener to a second end 52 of the shoulder strap 50; and contemporaneously moving the fastener and the second end 52 of the shoulder strap 50 along a bidirectional linear path defined along a top surface of the dry storage compartment 20.

While the disclosure has been described with respect to a certain specific embodiment, it will be appreciated that many modifications and changes may be made by those skilled in the art without departing from the spirit of the disclosure. It is intended, therefore, by the appended claims to cover all such modifications and changes as fall within the true spirit and scope of the disclosure. In particular, with respect to the above description, it is to be realized that the optimum dimensional relationships for the parts of the present disclosure may include variations in size, materials, shape, form, function and manner of operation.

What is claimed as new and what is desired to secure by Letters Patent of the United States is:

1. A multipurpose insulated cooler and heater bag comprising:

a dry storage compartment having an outer perimeter wall;

a cold storage compartment removably disposed inside said dry storage compartment, said cold storage compartment having a first side wall abutted against said outer perimeter wall;

a bottle warming compartment removably disposed inside said dry storage compartment, said bottle warming compartment having a second side wall abutted against said outer perimeter wall;

a shoulder strap having a first end anchored to an exterior surface of said dry storage compartment;

a fastener attached to said dry storage compartment and anchored to a second end of said shoulder strap respectively;

wherein said fastener and said second end of said shoulder strap contemporaneously move along a bidirectional linear path defined along a top surface of said dry storage compartment;

wherein said dry storage compartment is in fluid communication with one of said cold storage compartment and said bottle warming compartment; and a plurality of first passageways passing through said outer perimeter wall and said first side wall such that said dry storage compartment is in fluid communication with said cold storage compartment.

2. The multipurpose insulated cooler and heater bag of claim 1, wherein said first passageways comprise:

a plurality of first horizontally-oriented linear passageways each having a longitudinal length extending through an entire thickness of said outer perimeter wall and said first side wall; and a plurality of first crisscrossed linear passageways each having axially opposed ends in direct fluid communication with said first horizontally-oriented linear passageways, respectively.

3. The multipurpose insulated cooler and heater bag of claim 1, wherein said dry storage compartment is in fluid communication with both of said cold storage compartment and said bottle warming compartment.

4. The multipurpose insulated cooler and heater bag of claim 3, further comprising: a plurality of second passageways passing through said outer perimeter wall and said second side wall such that said dry storage compartment is in fluid communication with said bottle warming compartment.

5. The multipurpose insulated cooler and heater bag of claim 4, wherein said second passageways comprise:

a plurality of second horizontally-oriented linear passageways each having a longitudinal length extending through a combined thickness of said outer perimeter wall and said second side wall; and a plurality of second crisscrossed linear passageways each having axially opposed ends in direct fluid communication with said second horizontally-oriented linear passageways, respectively.

6. A multipurpose insulated cooler and heater bag comprising:

a dry storage compartment having an outer perimeter wall;

a cold storage compartment removably disposed inside said dry storage compartment, said cold storage compartment having a first side wall abutted against said outer perimeter wall;

a bottle warming compartment removably disposed inside said dry storage compartment, said bottle warming compartment having a second side wall abutted against said outer perimeter wall;

a shoulder strap having a first end anchored to an exterior surface of said dry storage compartment;

a fastener attached to said dry storage compartment and anchored to a second end of said shoulder strap respectively;

wherein said fastener and said second end of said shoulder strap contemporaneously move along a bidirectional linear path defined along a top surface of said dry storage compartment;

wherein said dry storage compartment is in fluid communication with one of said cold storage compartment and said bottle warming compartment;

wherein said first side wall is oppositely spaced from said second side wall;

wherein said each of said first side wall and said second side wall are located inside said dry storage compartment; and a plurality of first passageways passing through said outer perimeter wall and said first side wall such that said dry storage compartment is in fluid communication with said cold storage compartment.

7. The multipurpose insulated cooler and heater bag of claim 6, wherein said first passageways comprise:

a plurality of first horizontally-oriented linear passageways each having a longitudinal length extending through an entire thickness of said outer perimeter wall and said first side wall; and a plurality of first crisscrossed linear passageways each having axially opposed ends in direct fluid communication with said first horizontally-oriented linear passageways, respectively.

8. The multipurpose insulated cooler and heater bag of claim 7, wherein said dry storage compartment is in fluid communication with both of said cold storage compartment and said bottle warming compartment.

9. The multipurpose insulated cooler and heater bag of claim 8, further comprising: a plurality of second passageways passing through said outer perimeter wall and said second side wall such that said dry storage compartment is in fluid communication with said bottle warming compartment.

10. The multipurpose insulated cooler and heater bag of claim 9, wherein said second passageways comprise:

a plurality of second horizontally-oriented linear passageways each having a longitudinal length extending through a combined thickness of said outer perimeter wall and said second side wall; and a plurality of second crisscrossed linear passageways each having axially opposed ends in direct fluid communication with said second horizontally-oriented linear passageways, respectively.

11. A method of utilizing multipurpose insulated cooler and heater bag, said method comprising the steps of:

providing a dry storage compartment having an outer perimeter wall;

providing and removably disposing a cold storage compartment inside said dry storage compartment, said cold storage compartment having a first side wall abutted against said outer perimeter wall;

providing and removably disposing a bottle warming compartment inside said dry storage compartment, said bottle warming compartment having a second side wall abutted against said outer perimeter wall;

oppositely spacing said first side wall from said second side wall;

locating each said first side wall and said second side wall inside said dry storage compartment;

fluidly communicating said dry storage compartment with one of said cold storage compartment and said bottle warming compartment;

providing and passing a plurality of first passageways through said outer perimeter wall and said first side wall such that said dry storage compartment is in fluid communication with said cold storage compartment;

providing and anchoring a first end of a shoulder strap to an exterior surface of said dry storage compartment;

providing and attaching a fastener to said dry storage compartment;

anchoring said fastener to a second end of said shoulder strap; and contemporaneously moving said fastener and said second end of said shoulder strap along a bidirectional linear path defined along a top surface of said dry storage compartment.

* * * * *